US005456051A

United States Patent [19]

Queen et al.

[11] Patent Number: 5,456,051

[45] Date of Patent: Oct. 10, 1995

[54] COMPRESSION SPACER FOR BAR REINFORCEMENT

[75] Inventors: Frankie A. R. Queen, Lawrenceville; George T. Cloud, Lithia Springs, both of Ga.

[73] Assignee: Lowtech Corporation, Inc., Lawrenceville, Ga.

[21] Appl. No.: 176,529

[22] Filed: Jan. 3, 1994

[51] Int. Cl.[6] ..... E04C 5/16

[52] U.S. Cl. ..... 52/677; 52/679

[58] Field of Search ..... 52/677, 679, 684; 405/229, 239

[56] References Cited

U.S. PATENT DOCUMENTS

| | | | |
|---|---|---|---|
| 1,318,405 | 10/1919 | Perrott | 52/677 |
| 4,060,954 | 12/1977 | Liuzza | 52/677 |
| 4,063,397 | 12/1977 | Follows | 52/684 |

FOREIGN PATENT DOCUMENTS

| | | | |
|---|---|---|---|
| 634364 | 7/1963 | Belgium | 52/677 |
| 2021894 | 10/1971 | Germany | 52/677 |
| 2017101 | 10/1971 | Germany | 52/677 |
| 2264891 | 8/1975 | Germany | 52/677 |
| 3737645 | 5/1989 | Germany | 52/677 |
| 3804860 | 8/1989 | Germany | 52/677 |
| 3840603 | 6/1990 | Germany | 52/677 |
| 861604 | 2/1961 | United Kingdom | 405/239 |

OTHER PUBLICATIONS

Advertisement for "Hijacker Pier Bolster" by Pieresearch, 2 pages.

*Primary Examiner*—John A. Ricci
*Attorney, Agent, or Firm*—Hopkins & Thomas

[57] ABSTRACT

The spacer support (20) includes a support base (22) and a receptacle (26) which are welded together at interfitting annular flanges (46 and 64). A bearing plug (24) includes a circular support plate (48) covering the upper surfaces of the radial walls (36), with a tapered stem (50) projecting into a tapered center opening (34) of the support base (22). The flexible engagement fingers (66) allow one way movement of the rebar rod (14) into the receptacle (26), and the protrusions (18) of the rod engage the ends of the fingers (66), prohibiting separation of the spacer support (20) frown the rod (14).

10 Claims, 3 Drawing Sheets

COMPRESSION SPACER FOR BAR REINFORCEMENT

FIELD OF THE INVENTION

This invention relates in general to the formation of in-ground concrete foundation structures such as concrete pilings, piers and caissons. Generally, the present invention relates to a reinforcing cage of bar steel reinforcement for placement in a drilled or an excavated shaft in which concrete is to be poured. More particularly, the invention comprises a spacer support device that is quickly and easily attached to the lower ends of vertical steel reinforcement rebar rods of a rebar cage. The bar spacer supports engage the bottom surfaces of a drilled or excavated shaft into which the vertical bars of the cage are inserted and the spacer supports become part of the fabricated structural concrete steel reinforcement structure. The spacer supports are mounted onto the ends of vertical reinforcement bars prior to placement of the cage into the confines of the drilled or excavated shaft. Once the steel reinforcement cage is lowered into place, the spacer supports provide a compression seat for each vertical rebar rod and act as spacers between the lower ends of the steel reinforcement bars and the earthen bottom surface of the excavated or drilled shaft, providing a proper clearance for concrete placement and encapsulation by the concrete about the lower ends of the rebar rods, in order to properly form the foundation structure.

BACKGROUND OF THE INVENTION

It is well known in the construction and building industry that concrete structures require reinforcement means during the formation of the structures. Such reinforcement means typically are steel reinforcing bars or rods commonly known as "rebar".

The general procedure followed for forming a concrete foundation support structure such as a concrete pier involves drilling or excavating a shaft or hole in the ground at a predetermined location. A reinforcement cage is formed from reinforcing steel and is inserted into the drilled or excavated shaft. The reinforcement cage typically is fabricated above ground from a series of elongated steel rebar rods or similar reinforcement materials. The steel rods are usually arranged in a substantially parallel cylindrical array and are bound together in this configuration by laterally oriented rebar ties and tied thereto with conventional tie-wire.

Another configuration of the laterally extending rebar ties is an elongated section of rebar that is wound about the parallel steel rods in a helical configuration. The ties are connected to the reinforcement cage at points of contact between the parallel rods and the rebar ties by tie-wire. The rebar ties hold the parallel rods in an elongated cylindrical cage configuration. The assembled steel reinforcement cage is lowered into the drilled or excavated shaft prior to the pouting of concrete therein.

As the concrete is poured, it is desirable that the lower ends of the vertical rods of the reinforcement cage be properly supported and spaced for clearance from the bottom of the drilled or excavated shaft. A problem faced by drilled shaft contractors is trying to insert the rebar cage into a drilled or excavated shaft and maintaining the proper clearances between the cage and the side and bottom surfaces of the shaft, and also to properly support the lower ends of the vertical rods of the cage on the bottom of the drilled or excavated earthen shaft. Once the cage has been inserted into the shaft, concrete is poured about the cage to form the foundation structure.

In order to solve this problem of maintaining the vertical bar reinforcement cage in a supported and spaced clearance position in relationship to the bottom of the drilled or excavated earthen shaft space, contractors have suspended the entire cage of bar reinforcement within the drilled or excavated shaft as the concrete is poured. It is also common practice among drilled shaft foundation contractors to attach spacers to the lower ends of the vertical bars so that the bars will rest on the spacers. The spacers engage the bottom surface of the drilled or excavation shaft and prevent the reinforcement cages from coming into contact with the earthen surface and support the bar reinforcement steel cage at the same time.

There are two types of prior art spacers known to the inventor that have been utilized as spacing and support devices for concrete foundation cages. These spacers usually are installed on reinforcement cages at the building site. The first type of spacer generally used is a simple solid concrete or cementitious block that is formed in the field from waste concrete or formed from concrete purchased from a materials supply company. These solid concrete spacers typically are square or rectangular shaped and may or may not have tie-wires imbedded in them. The cementitious block spacers formed in the field are the ones that usually have the wires imbedded in them. The cast-in-field blocks generally must cure for a period of 28 days in order to obtain their designed structural strength. The ties imbedded within the cementitious monolith may be rusty which may spread to the bar reinforcement like a cancer, and the fabricated block usually is tied to the ends of the bar reinforcement by skilled ironworkers.

It is difficult and time consuming to tie or otherwise fasten the cementitious blocks to the ends of the vertical bar reinforcement and have the blocks be kept in place on the end of the bar for placement in the shaft without the blocks dangling loosely from the ends of the vertical bar during the placement of the fabricated cage in the shaft. Another problem with the cast-in-field cementitious blocks is that the concrete is generally not cured sufficiently or monitored for strength prior to the cage of steel reinforcement being lowered into the shaft, and the blocks sometimes are brittle and the weight of the bar reinforcement steel cage cracks the blocks.

The cementitious blocks purchased from a material supply company usually are low psi strength blocks, unreinforced and brittle. The purchased blocks are attached to the ends of the vertical bar reinforcement again by skilled ironworkers in a similar fashion as referenced in the cast-in-field application of spacer blocks. Similar drawbacks generally apply in the use of the purchased cementitious blocks as with the cast-in-field blocks. Both type blocks tend to break when a weight such as that of a cage of fabricated bar reinforcing steel is placed upon it because the weight of the cage of steel is concentrated on the longitudinal bars and spread over a small surface area at the ends of the bars.

Another prior art support for a rebar cage is a prefabricated cementitious solid block with imbedded wires known as the "pier bolster" and manufactured by Pieresearch of Arlington, Tex. This product is designed and produced in generally the same fashion as the concrete blocks that are cast in the field as referenced above, and are tied to the ends of the bar reinforcement in about the same fashion as those blocks cast in the field. The pier bolster blocks are tied to the lower ends of the steel reinforcing bars utilizing skilled ironworkers and the blocks usually are not secure about the ends of the bars when tied. The pier bolster usually is left dangling from the bottom ends of the reinforcing bars just like the cast-in-field blocks and the purchased cementitious blocks as described above. When the cage is set there is no guarantee that the blocks remain in true position underneath the steel reinforcement, and the blocks could possibly fall off the cage during placement. Another problem that exists in the utilization of the pier bolster is the weight of the block. The pier bolster blocks known to this inventor weigh approximately two pounds and require two men to fasten the block to the rebar cage when the cage is suspended over the shaft.

Most construction sites usually present muddy and wet conditions during the stage of foundation construction. By placing the steel reinforcing cage upon the blocks and fastening them to the ends of the reinforcing steel prior to placement sometimes causes the blocks to become contaminated with mud, etc. prior to placement in the shaft and the blocks require cleaning prior to placement. If placed into the shaft unclean, the concrete poured into the shaft to form the foundation tends to not properly bond to the contaminated surfaces.

Another problem with the pier bolster is the shelf life of the unit when not used. The concrete usually is not a problem during storage, but the tie wires embedded into the concrete monolith are likely to rust in a short period of time due to the typical corrosive environment and atmosphere that the units usually are stored in. Once the wires have rusted, some engineers will not allow the rusted or contaminated wires to contaminate the steel reinforcement. If the rusting is severe enough, then the wires may break during the fastening process. Galvanization and epoxy coatings have been used to prevent or slow the corrosive rusting process, but the galvanizing and epoxy coating processes are expensive and add more cost to the final product.

Another prior art design does not relate to the support of bar reinforcement within a concrete foundation, but is related to the fastening of a cap over the ends of bar reinforcement. The steel reinforcement bars (rebar) are usually sheared during fabrication which leaves sharp and irregular ends that can cut or cause serious injury if accidental contact happens. There are several types of plastic caps that have been placed over the ends of the bars for safety purposes. These caps usually are bright colored, orange or yellow, plastic cap devices placed over the upper exposed ends of exposed and protruding steel bars after a portion of the bars have been partially encapsulated in concrete and prior to a second pour. The bright colored plastic caps are placed onto the exposed top ends of the bars and the caps provide a smooth rounded surface about the ends of the steel reinforcement bars.

The plastic caps are secured about the reinforcing steel with flexible plastic flaps inside the cup part of the cap which bind against the bar reinforcement steel to hold it in place during use, but the flaps are also flexible enough for removal and subsequent reuse of the caps. These plastic caps are not universal and are not designed to provide an engineered structural product for construction. These caps are for safety only and are not designed to withstand and support the immense structural compressive forces imposed by the bar reinforcement cage.

Accordingly, it can be seen that it would be desirable to provide steel reinforcement rebar cages for concrete structures with spacers at the lower ends of the vertical bars which maintain space between the bars and the bottom surface of a drilled or excavated shaft. Further, it would be desirable to provide a spacer support which will retain an indefinite shelf life during storage and handling; and which is engineered structurally sound and sufficient to provide the necessary support for the rebar cage, and which is lightweight and which locks onto the end of the bar reinforcement rod, utilizing minimal unskilled labor and provides a specified spacing clearance separating and protecting the lower end of the rod from the earthen surfaces of a drilled or excavated shaft.

SUMMARY OF THE INVENTION

Briefly described, the present invention comprises a compression spacer support for a rebar cage of a concrete foundation support structure such as concrete pilings, caissons or piers. The rebar steel reinforcement cage, when installed, typically includes a series of parallel, vertically oriented reinforcement steel bars or rods, commonly known as "rebar", bound together in a substantially cylindrical array by laterally oriented rebar ties positioned along the lengths of the parallel rods. In the embodiment disclosed herein, the spacer support assemblies are mounted on the lower ends of the vertical rods of a rebar cage and function to space and support the lower ends of the rods from the earthen surfaces of the drilled or excavated shaft.

In a preferred embodiment of the invention, the compression spacer support is formed of three molded parts of similar materials. Two of the parts, the upper half which functions as a receptacle of the lower end of the vertical rebar rod, and lower half, which functions as the support base, are fabricated of similar materials that can be welded together. The third part, an interior beating plug, may be fabricated of similar materials, but could be manufactured utilizing recyclable plastics.

The lower section or support base is engineered and designed to accommodate the weight of the bar reinforcement steel that will be placed upon it. The support base is capable of withstanding impact from the placement of the steel reinforcement bar cage yet lightweight enough to be economical to manufacture and transport and to install.

The lower support base receives a specifically designed bearing plug which is inserted into the center of the support base prior to the upper receptacle being placed onto it and welded. The bearing plug provides the spacer support with additional structural compressive integrity and resistance as well as providing a uniform universal bearing surface to accept variable sized vertical bar reinforcement. The bearing plug includes a bearing head which provides a uniform beating surface on top of the support base to accept the variable sized bars.

The upper component section of the spacer support is a guide and gripping device that functions as a receptacle for attaching the spacer support to the ends of the steel bar reinforcement. The receptacle is engineered and designed to guide the bar reinforcement centrally through a series of spaced tapered fingers or engagement members that are integrally made into the side walls of the receptacle. The tapered fingers are angled downwardly toward the center axis of the receptacle to act as a funnelling system and to guide the steel bar reinforcement into and through the upper receptacle and to center the steel bar reinforcement precisely onto the center of the receptacle and bearing plug. The tapered fingers not only act as a guide for the placement of reinforcement bars through the upper half cupped section, but also function as gripping fingers which are forced against the sides of the bar reinforcement steel due to the tensile rebound forces of the plastic materials. The force applied by the fingers against the sides of the steel reinforcement bar tend to grip the steel bar deformations. The ends of the tapered fingers tend to engage the deformations of the rebar when the spacer support is pulled in the opposite direction. This tendency causes the receptacle to remain in place and centralized on the end of the steel bar. The lower support base and bearing plug are designed to accommodate the weight of the rebar cage. The receptacle section of the spacer support keeps the end of the rebar rod centered in the support base of the spacer support.

By properly engineering and designing the spacer support and utilizing the proper manufacturing materials, the spacer support is capable of utilization on variable sized steel bar reinforcement which eliminates the need to manufacture variable sized units for variable sized steel bars. Each of the spacer support elements typically is molded from plastic materials, although other types of materials may be utilized as well.

Thus, it is an object of this invention to provide an improved compression spacer support for a rebar cage, with the compression spacer support being telescopically mounted upon the lower end of a rebar rod of a cage, and the rebar cage inserted downwardly into the drilled or excavated shaft or geotechnical construction application, which is to be a part of a concrete pier, etc.

Another object of this invention is to provide a compression spacer support that is adaptable to mount upon rebar of various diameters, and which will not tend to fall off the rebar during the handling of the rebar, and which functions to adequately support the rebar in a vertical attitude and spaced from the bottom surface of the drilled shaft, etc.

It is another object of the invention to provide spacer supports for rebar cages which are light weight, inexpensive, easy to install, have a long shelf life, which provide the necessary support for the rebar cage, and which are not likely to be displaced during the installation of the rebar cage into a shaft, etc.

Other objects, features and advantages of the present invention will become apparent upon reading the following specification, when taken in conjunction with the accompanying drawings.

DETAILED DESCRIPTION

Figure 1:
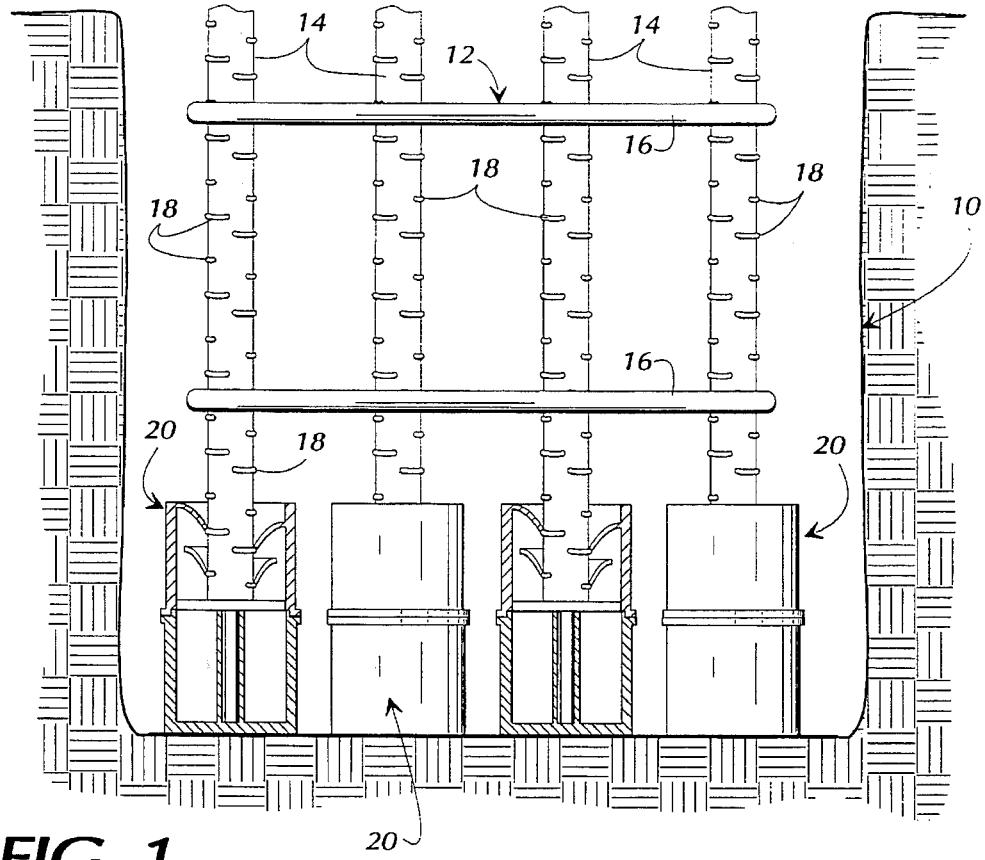
FIG. 1 illustrates the lower end portion of a rebar cage, showing vertical segments of rebar, and with the lower end of each rebar rod being received in a spacer support of the invention.

Referring now in greater detail to the drawings in which like numerals indicate like parts throughout the several views, FIG. 1 illustrates a drilled or bored shaft 10, and a rebar cage 12 is positioned in the shaft. The rebar cage comprises a plurality of rebar rods 14 extending vertically into the shaft 10, with the rods 14 being arranged generally in a cylindrical array and connected together by ties 16. The rebar rods 14 each include laterally extending protrusions 18 at intervals spaced along their lengths and with the protrusions extending in various directions about each bar. This is common in the prior art.

A spacer support 20 is mounted on the lower end of a rebar rod 14.

Figure 3:
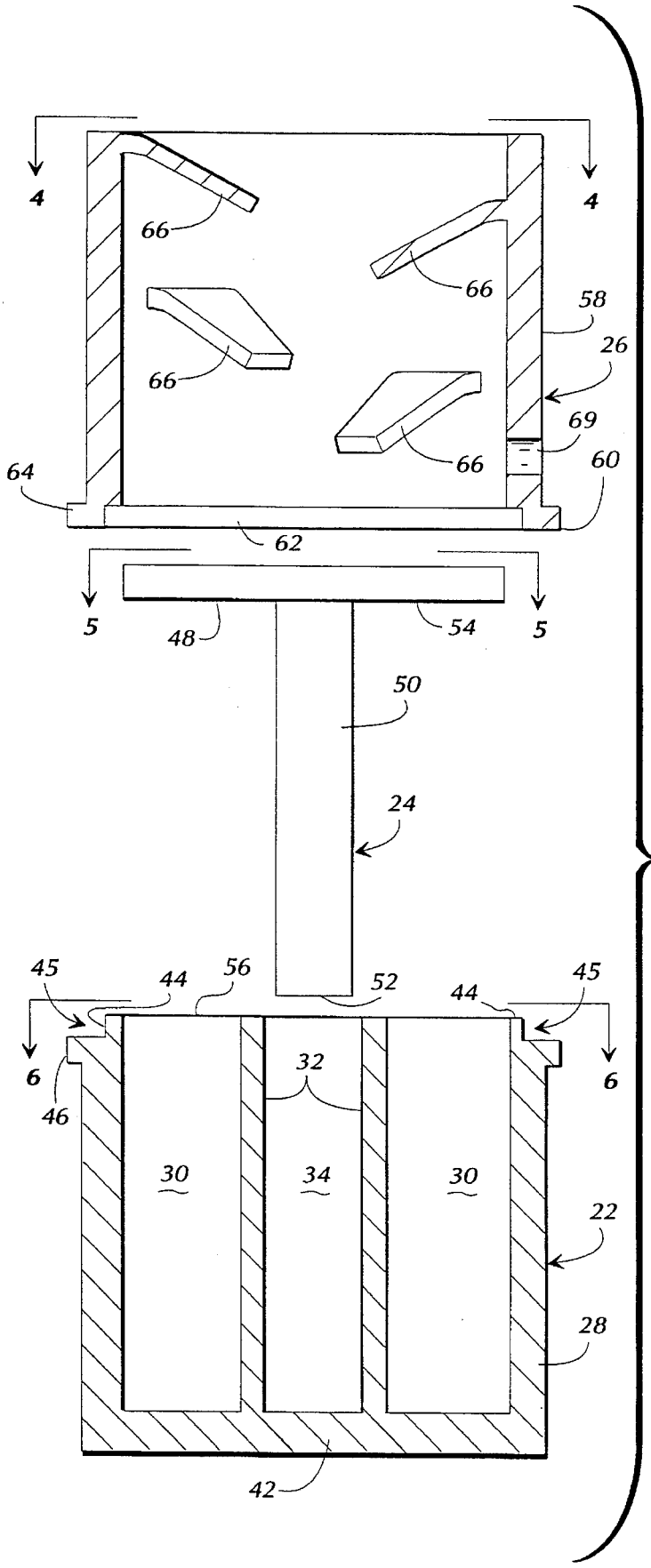
FIG. 3 is an exploded view of the spacer support before it is connected together.
Figure 4:
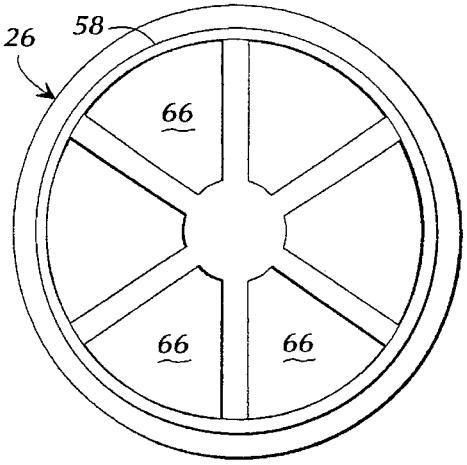
FIG. 4 is a top view of the spacer support, taken along lines 4—4 of FIG. 3.
Figure 5:
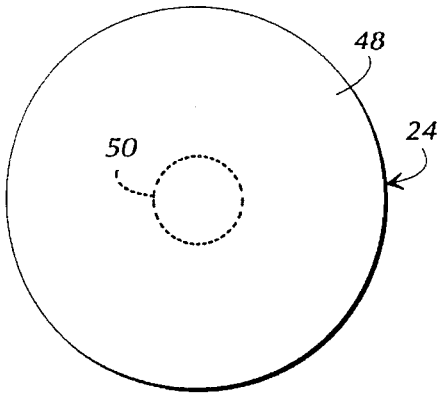
FIG. 5 is a top view of the bearing plug, taken along lines 5—5 of FIG. 3.
Figure 6:
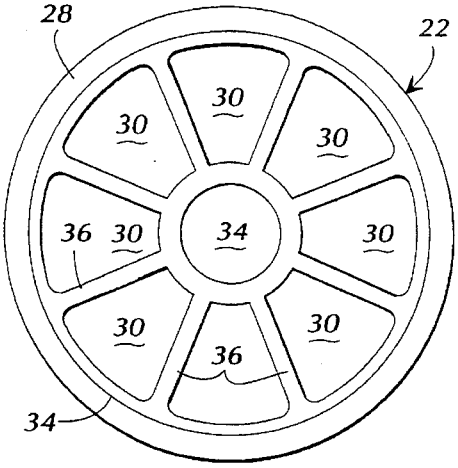
FIG. 6 is a top view of the support base of FIG. 3, taken along lines 6—6 of FIG. 3.

As illustrated in FIG. 3, a spacer support 20 includes three segments, a support base 22, a bearing plug 24, and a receptacle 26. The support base 22 is the lower section of the assembly and functions to support the compression forces applied to the spacer support by the rebar rod. As illustrated in FIG. 6, the support base 22 comprises a cylindrical outer wall 28 and a cylindrical inner wall 32. The cylindrical walls 28 and 32 are concentric, with inner wall 32 forming the centrally located cylindrical tapered opening 34 that functions as a stem receiving opening. Radial walls 36 extend outwardly from inner wall 32 to the cylindrical outer wall 28, so as to form an array of cavities.

As illustrated in FIG. 3, support base 22 includes a flat bottom wall 42 that closes the lower portion of the support base. The upper rim 44 of the cylindrical outer wall 28 includes an annular notch 45 and an annular flange 46.

Bearing plug 24 includes a circular support plate 48 and a tapered stem 50 that extends at a right angle to the support plate and is centrally mounted to the support plate. The tapered stem 50 is sized and shaped to be received in the central cylindrical tapered opening 34 of the support base 22, with the lower surface 52 of the stem facing top surface 43 of the bottom wall 42 of the support base. The lower surface 54 of the circular support plate rests against the upper surfaces 56 of cylindrical wall 32 and radial wall 36 of the support base 22 when the stem 50 is fully inserted in the central opening 34. The diameter of the circular support plate 48 is less than the interior diameter of the cylindrical outer wall 28 of the support base 22 and the stem 50 holds the circular support plate 48 in position out of contact with the receptacle 26.

Figure 7:
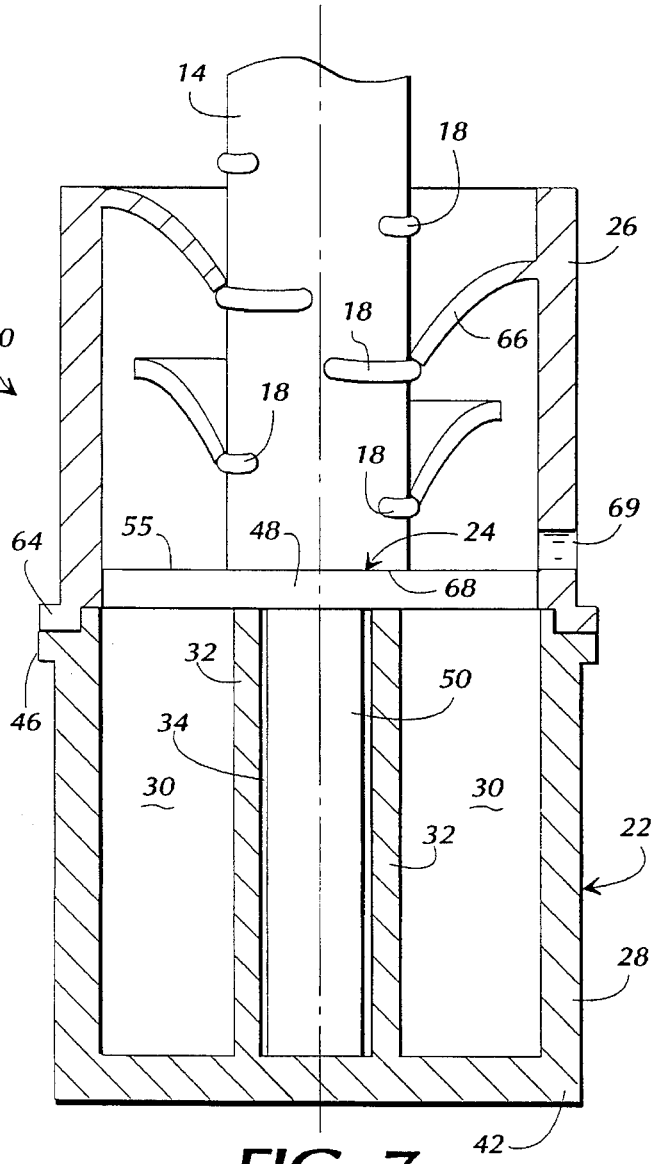
FIG. 7 is an enlarged cross-sectional view of the spacer support assembly showing how the lower end of a rebar rod is received in the spacer support.

Receptacle 26 includes an open ended cylindrical outer wall 58 which is concentric with outer wall 28 of support base 22. Outer wall 58 has a lower rim 60 having an interior annular notch 62 and an outwardly protruding annular flange 64. The notch 62 and flange 64 are sized and shaped to interfit with the annular notch 45 and annular flange 46 of the support base 22, as shown in FIG. 7.

A plurality of engagement fingers 66 are formed in cantilever arrangement with respect to cylindrical outer wall 58 of receptacle 26. There are two rows of fingers and the bases 67 of the fingers are arranged in a circle about the receptacle. Each finger 66 extends radially inwardly of the receptacle 26, and each finger is sloped downwardly toward support base 22 and bearing plug 24. The base 67 of each finger 66 is curved and is attached to the inner curved surface of the cylindrical outer wall 58 of the receptacle 26. These curved lines of connection tend to maintain the fingers in its downwardly sloped attitudes, but the fingers are flexible and can be deflected downwardly. The two rows of fingers cause the receptacle to be axially aligned on the end portion of the rebar rod.

Drain hole 69 is formed in the receptable 26.

When the support base 22, bearing plug 24 and receptacle 26 of FIG. 3 are assembled to form the spacer support 20, the bearing plug has its stem 50 received in the central opening 34 of the support base 22, with the lower surface 54 of the circular support plate 48 resting on the upper surfaces of the inner wall 32 and the radial walls 36 and its upper surface 55 facing upwardly. The annular notch 62 and annular flange 64 of the receptacle mate with the annular notch and flange 45 and 46 of the support base, with the circular support plate 48 of the plug 24 being captured inside the receptacle 26, beneath the engagement fingers 66. Since the diameter of the circular support plate 48 is smaller than the interior diameters of the cylindrical outer wall 58 of the receptacle 26 and the cylindrical outer wall 28 of base 22, the support plate 48 will be loosely held inside the spacer support 20, yet trapped in place inside the spacer support.

Figure 2:
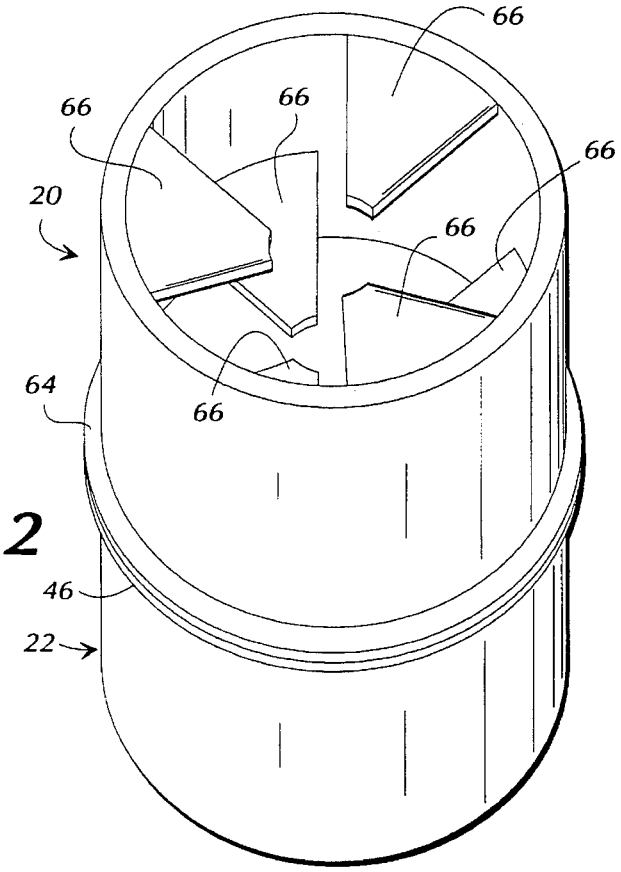
FIG. 2 is a perspective illustration of the spacer support.

Once the support base 22, bearing plug 24 and receptacle 26 have been assembled, the facing surfaces of the annular flanges 46 and 64 of the support base 22 and receptacle 26 are sonically welded together, so that the support base 22 and receptacle 26 become rigidly bonded together, as illustrated in FIG. 2.

As illustrated in FIG. 7, when the lower end of a rebar rod 14 is inserted into the receptacle 26 of a spacer support 20, the inward telescopic movement of the end of the rebar rod into the receptacle causes the rod to engage and to deflect the engagement fingers 66 of the receptacle, so that the spacer support 20 and bar 14 are guided together in a coaxially aligned relationship, so that the longitudinal center line of the bar 14 is substantially aligned with the longitudinal center line of the spacer support 20.

As the rebar rod 14 progressively moves into the receptacle 26, the protrusions 18 of the rebar rod pass by and deflect the inner ends of the engagement fingers 66. Because of the downwardly inclined attitude of the fingers 66, the fingers 66 will resist any outward movement of the rebar rod 14 from the receptacle 26 by virtue of the ends of the fingers engaging the protrusions 18. Therefore, once the rebar rod 14 has been inserted into the receptacle 26, it usually is difficult to remove the spacer support from the rod.

When the rebar rod 14 has been fully inserted into the receptacle, the inner end surface 68 of the rebar rod engages and rests upon the upper surface 55 of the bearing plug 24. When weight of the rebar cage is applied by the rod to the spacer support 20, the weight then will be spread by the bearing plug 24 uniformly across the upper surfaces of the inner walls 32 and 36. This aids in distributing the load applied by the rebar rod to the spacer support, particularly when the rebar rod is of relatively small diameter and would otherwise just engage a small portion of the upper surface of the radial walls 36 of the support base 22.

With this arrangement it can be seen that the spacer supports 20 have a larger bottom surface area than the rods and support the rebar cage in spaced relationship with the bottom of the excavated shaft. Further, the spacer supports are of a breadth larger than the rods 14, which causes the supports to project laterally from the rods and may, in some instances, engage the side surfaces of the excavation and prevent the rods from engaging the side surface of the excavation. This tends to cause all of the vertical rebar rods at the lower end of the cage to be encapsulated in the concrete which is poured about the cage.

In the event that rainwater or other liquid finds its way into the support base, the drain hole 69 will allow the liquid to move through the support base.

In some uses of the invention, it is desirable that the support base 22 be a solid block of material to completely block the receipt of rainwater and other liquid in the support base. This can be accomplished by filling the cavities 40 of the support base with grout, putty, or other nonporous filter material which is a long-lasting filler.

While the foregoing specification and drawing disclose a preferred embodiment of the invention, it will be understood by those skilled in the art that variations and modifications thereof can be made without departing from the spirit and scope of the invention as set forth in the following claims.

We claim:

1. A spacer support for supporting an end of a vertically installed rectilinear rebar rod with a plurality of protrusions along its length, and for supporting reinforcing assemblies which include a plurality of said rods, including reinforcing assemblies which include a plurality of said rods held together in the form of a cage by lateral ties, said spacer support comprising:

a support base; and a receptacle rigidly mounted to said support base for telescopically receiving an end of a rebar rod for mounting said support base in fixed alignment with the end of the rebar rod, said receptacle including an outer approximately cylindrical wall defining a rod-receiving space sized and Spaced for telescopically receiving an end of a rebar rod and having a plurality of inwardly protruding flexible engagement members formed on said outer wall and sloped toward said support base for yieldably engaging the rebar rod and its protrusions when said spacer support is installed on the rebar rod;

so that said spacer support can be telescopically mounted about the lower end of a vertically oriented rebar rod and said support base will be positioned to support the rebar rod.

2. The spacer support of claim 1, wherein:

said support base forms an end of said rod-receiving space so as to make contact with the end of the rebar rod and to limit the extent of penetration of the rod into said rod receiving space; and said flexible engagement members extending toward the center of said rod receiving space such that one or more of said flexible engagement members will make contact with the rebar rod when said spacer support is installed on said rod, and said flexible engagement members being flexibly deformable after making contact with the rebar rod for exerting pressure on the exterior surface of the rebar rod and engaging the protrusions on the rebar rod so as to resist subsequent movement of said support relative to the rebar rod.

3. The spacer support of claim 2, and wherein:

said rod-receiving space is substantially cylindrical and has a length and internal diameter sufficient to mount said spacer support on the end of a rebar rod substantially without allowing the spacer support to tilt with respect to the rebar rod; and said support base having a cylindrical exterior surface with a substantially flat end of a breadth larger than the cross sectional area of the rebar rod for applying the weight of the rebar rod to a large area of the surface against which it rests.

4. A spacer support for mounting to an end of a substantially rectilinear rebar rod having external protrusions, said spacer support comprising:

a support base, said support base including an inner wall and an outer wall concentric about said inner wall and connected to said inner wall by at least one radial wall extending between said inner and outer walls;

a receptacle mounted to said support base and defining a rod-receiving space sized and shaped for telescopically receiving an end of a rebar rod and mounting said support base in aligned relationship with the end of the rebar rod; and at least one flexible engagement member protruding inwardly of said receptacle into said rod receiving space for yielding engagement with the rebar rod and its external protrusions received in said rod receiving space;

so that when said spacer support is mounted on the end of a rebar rod with the end of the rod received in said rod receiving space of the receptacle, said support base of the spacer support is held coextensively aligned with the rebar rod and said flexible engagement member engages external protrusions of the rebar rod within said receptacle to hold said spacer support on the rod.

5. A rebar rod cage assembly for mounting in a shaft cavity or the like, said cage assembly comprising:

a plurality of rebar rods extending approximately parallel to each other in an approximately cylindrical array, said rebar rods each having external protrusions, tie means holding said rebar rods in said circular array;

spacer supports mounted on adjacent ends of said rebar rods, said spacer supports each comprising:

a support base, a receptacle affixed to said support base and having an outer wall sized and shaped to receive an end of a rebar rod and mounting said support base in coextensive alignment with the end of a rebar rod; and a plurality of flexible rod-engagement members formed on the inner surface of said outer wall of said receptacle in at least two rows and radially extending inwardly of said receptacle and sloped toward said support base for yieldably engaging a rebar rod;

so that said spacer supports are telescopically mounted on the end of the rebar rods of the rebar rod cage, the cage is inserted said spacer supports-first downwardly into a shaft or the like with said spacer supports held on the rods and said support base of each said spacer support positioned to support the rebar cage.

6. A spacer support for supporting an end of a vertically installed rectilinear rebar rod with a plurality of protrusions along its length, and for supporting reinforcing assemblies which include a plurality of said rods, including reinforcing assemblies which include a plurality of said rods held together in the form of a cage by lateral ties, said spacer support comprising:

a support base including a substantially cylindrical outer wall and an end wall, an inner, substantially cylindrical wall concentric with respect to said outer wall and forming a centrally positioned stem receiving opening, and a plurality of radial walls extend between said inner and outer cylindrical walls, and further including a bearing plug having a circular support plate in engagement with said inner cylindrical wall and said radial walls and a stem projecting into said stem receiving opening; and a receptacle for telescopically receiving an end of a rebar rod for mounting said support base in fixed alignment with the end of the rebar rod so that the end of the rebar rod engages said support plate of said bearing plug;

whereby said spacer support can be mounted to the lower end of a vertically oriented rebar rod and said support base will be positioned to support the rebar rod.

7. The spacer support of claim 6 and further including a nonporous filler material filling the spaces between said inner and outer cylindrical walls.

8. The spacer support of claim 6 and wherein drainage openings are formed in said receptacle means.

9. A spacer support for mounting to an end of a substantially rectilinear rebar rod having external protrusions, said spacer support comprising:

a support base;

a receptacle mounted to said support base and defining a rod-receiving space sized and shaped for telescopically receiving an end of a rebar rod and mounting said support base in aligned relationship with the end of the rebar rod, said receptacle being cylindrical; and at least one flexible engagement member protruding inwardly of said receptacle into said rod receiving space for yielding engagement with the rebar rod and its external protrusions received in said rod receiving space, said at least one flexible engagement member including a plurality of fingers in a circular array extending inwardly of said cylindrical receptacle, and each flexible engagement member is connected on a curved line of connection to said cylindrical receptacle, and each flexible engagement member is sloped toward said support base;

so that when said spacer support is mounted on the end of a rebar rod with the end of the rod received in said rod receiving space of said receptacle, said support base of said spacer support is held coextensively aligned with the rebar rod and said flexible engagement member engages external protrusions of the rebar rod within said receptacle to hold said spacer support on the rod.

10. A rebar rod cage assembly for mounting in a shaft cavity or the like, said cage assembly comprising:

a plurality of rebar rods extending approximately parallel to each other in an approximately cylindrical army, said rebar rods each having external protrusions, tie means holding said rebar rods in said circular array;

spacer supports mounted on adjacent ends of said rebar rods, said spacer supports each comprising:

a support base including a substantially cylindrical outer wall, a substantially cylindrical inner wall defining a stem receiving opening, and radial walls extending between said inner and outer cylindrical walls, a bearing plug including a support plate overlying said inner cylindrical wall and said radial walls and a stem centrally mounted to said support plate and received in said stem receiving opening;

a receptacle affixed to said support base and sized and shaped to receive an end of a rebar rod and mounting said support base in coextensive alignment with the end of a rebar rod so that the end of a rebar rod bears against said beating plug; and a plurality of flexible rod-engagement members protruding inwardly of said receptacle and yieldably engaging a rebar rod and its protrusions received in said receptacle;

so that said spacer supports are telescopically mounted on the end of the rebar rods of the rebar rod cage, the cage is inserted said spacer supports-first downwardly into a shaft or the like with said spacer supports held on the rods and said support base of each said spacer support positioned to support the rebar cage.

* * * * *